United States Patent [19]

Pinkerton et al.

[11] Patent Number: 4,574,820

[45] Date of Patent: Mar. 11, 1986

[54] BUCCAL END DEVICE FOR A SMOKING ROD

[75] Inventors: William Pinkerton, Belfast; Sherman J. A. Hawthorne, Larne, both of Northern Ireland

[73] Assignee: Gallaher Limited, England

[21] Appl. No.: 597,486

[22] Filed: Apr. 6, 1984

[30] Foreign Application Priority Data

Apr. 7, 1983 [GB] United Kingdom ..... 8309451

[51] Int. Cl.[4] ..... A24D 3/04

[52] U.S. Cl. ..... 131/339; 131/336; 131/361

[58] Field of Search ..... 131/210, 216, 336, 344, 131/339–341, 361

[56] References Cited

U.S. PATENT DOCUMENTS

| | | | |
|---|---|---|---|
| 3,103,221 | 9/1963 | Harris | 131/344 |
| 3,172,410 | 3/1965 | Miller . | |
| 3,330,284 | 7/1967 | Seman et al. | 131/339 |
| 3,457,927 | 7/1969 | Siragusa | 131/339 |
| 3,496,945 | 2/1970 | Tomkin | 131/339 |
| 3,601,133 | 8/1971 | Van Eck | 131/339 |
| 4,273,141 | 6/1981 | Van Tilburg | 131/339 |
| 4,413,641 | 11/1983 | Dwyer, Jr. et al. | 131/361 |

FOREIGN PATENT DOCUMENTS

| | | | |
|---|---|---|---|
| 1365712 | 6/1963 | France . | |
| 2113069 | 8/1983 | United Kingdom | 131/340 |

*Primary Examiner*—V. Millin
*Assistant Examiner*—H. Macey
*Attorney, Agent, or Firm*—Andrus, Sceales, Starke & Sawall

[57] ABSTRACT

A cigarette with a tobacco rod (5,6) has at its buccal end a filter plug (10) and a hollow tubular core (8) with a cross wall (9) formed with orifices of a certain size and shape. Ventilating air drawn in through perforations (12) in a tipping wrapper (7) and through a porous inner wrapper (11) is mixed with smoke drawn through the tobacco rod and the mixture is sucked through the orifices (13) which promote particular mixing and pressure drop effects.

12 Claims, 4 Drawing Figures

BUCCAL END DEVICE FOR A SMOKING ROD

We have recognized advantages in providing at the buccal end of a smoking rod a device which both allows ventilating air to be drawn through the device into the smoker's mouth with the smoke from the tobacco rod, but also provides a high pressure drop and low filtration efficiency.

One known method of providing a high pressure drop involves forcing the smoke to pass through one or more constricted orifices. Thus U.S. Pat. No. 4,273,141 discloses a device for the buccal end of a ventilated smoking rod, the device comprising a tubular core the interior of which is provided partway along the core with a transverse cross wall having a plurality of constricting orifices formed through the wall. However, this prior disclosure does not address itself to details of the size and shape of the orifices, or to the minimum clear void existing within the core upstream and downstream of the orifices, which factors we now believe to be of importance.

In accordance with the present invention, a device for the buccal end of a ventilated smoking rod comprises a tubular core which is arranged, in use, to be connected at its upstream end to the buccal end of a tobacco rod whereby smoke from the tobacco rod and ventilating air are drawn through the core by the smoker, the interior of the core being provided partway along the core with a transverse cross wall having a plurality of constricting orifices formed through the wall, and is characterised in that the width of each orifice at one end, preferably, its entrance, is greater than at its other end, that the minimum width of each orifice is greater than its axial length, and that a clear void exists at least 1 mm upstream and downstream of each orifice.

With this arrangement, any desirable high pressure drop that is required can be provided, and as filtration will not occur by impaction on any downstream filter element, the filtration efficiency can be as low as desired.

The clear void preferably extends at least 2 mm, and most preferably at least 5 mm, upstream and downstream of each orifice.

The orifices, which are preferably at least three in number, may be symmetrically arranged in the cross wall, for example in a ring of three, four or five orifices. When the orifices are of circular cross section, they may each have a minimum diameter of between 0.4 and 0.6 mm. The aggregate of the cross sectional areas of the most constricted portions of all the orifices is suitably between 0.5 and 1.1 sq mm.

The narrowing of the holes in the axial direction, particularly in the downstream direction, has a number of advantages. Surprisingly, it prevents build up of tar in the orifices, provides the required pressure drop, and, when ventilating air is supplied to the core upstream of the cross wall, promotes proper mixing of the smoke and air. Also, when the cross wall is moulded with the orifices, it assists manufacture.

The larger width of each orifice at its one end, than at its other end, may be provided by bevelling the one end, and the bevelled portion may lead into a substantially cylindrical portion which extends to the other end. When the orifice is circular, the bevelling may be conical with an included cone angle of approximately 60°. Good results are obtained if the bevel extends at least three quarters of the way along the axial length of the orifice. The width of the cylindrical portion is preferably greater than the axial length of the cylindrical portion by a factor of at least two. This provides turbulent flow through the orifice, without having to make the wall unacceptably thin around the orifice.

The tubular core may consist of two tubular parts arranged end to end and sandwiching between them a disc, which forms the cross wall and is provided with the orifices. Preferably, however, the cross wall is moulded integrally with the rest of the tubular core from a plastics material. Conveniently the outer diameter of the tubular core, or of the tubular core when surrounded by an inner wrapper, will be substantially the same as that of a tobacco rod with which the device is to be used, so that the two may be united by a conventional surrounding tipping wrapper.

In order to prevent particles of tobacco from the tobacco rod entering the upstream void in the device and possibly blocking the orifices in the cross wall, a plug of conventional filter material may be provided upstream of the tubular core, in use sandwiched between the downstream end of a tobacco rod and the tubular core. The plug may be axially short compared with the length of the tubular core and may be made of a material, such as conventional acetate filter material, of low filtration efficiency.

A similar plug of filter material may be provided at the downstream end of the tubular core closing the void downstream of the cross wall. This may be considered desirable in order to provide the smoker with a buccal end of the smoking rod which appears, and feels to the tongue, like a conventional filter tip cigarette. However, a particular advantage exists if the void downstream of the cross wall is open to the smoker's mouth. This is because the smoke passing through an orifice in the cross wall leaves the orifice in a high velocity turbulent jet which, a few millimeters after leaving the orifice, explodes into dispersed smoke eddies. When such eddying smoke is received directly in the smoker's mouth, it stimulates a larger area of taste buds and the smoker senses extra flavour, for the same concentration of tar in the smoke. When the exit from each orifice is unobstructed from the atmosphere through the downstream end of the device, it is desirable if a clear void of at least 8 mm, and preferably at least 10 mm, exists between each orifice exit and the downstream end of the tubular core.

Ventilating air may be channelled into the tubular core of the device either upstream or downstream of the cross wall. If it is downstream, some opening for ventilating air must be provided through the peripheral wall of the tubular core and through any surrounding wrapper. Although this is possible in practice, it is difficult to provide the necessary opening if the tubular core including the cross wall is formed as an integral moulding. Also, if the downstream void is open at its downstream end, the channelling of the ventilating air into this void slows the flow velocity and produces less turbulence.

Preferably, therefore, the ventilating air is channelled into the tubular core in the void upstream of the cross wall so that it mixes with the smoke before passage through the orifices. In this case it is not necessary for the air to be drawn in through openings in the tubular core and it may be drawn in through the periphery of the previously mentioned plug of filter material. If this plug of filter material has a low filtration efficiency, all that is necessary is for a surrounding wrapper or wrappers, such as an inner plug wrapper surrounding and uniting the tubular core with the plug of filter material, and a tipping wrapper uniting the device with a tobacco rod, each to be provided, at least around the plug of filter material, with an air permeable, i.e. porous or perforated, area in the manner of conventional ventilation perforations in a tipping wrapper. The ventilating air will then be drawn in through the wrapper or wrappers, into the plug of filter material, and hence with the smoke into the upstream end of the tubular core.

An example of a cigarette incorporating a buccal end device in accordance with the present invention is illustrated diagrammatically in the accompanying drawings, in which.

Figure 1:
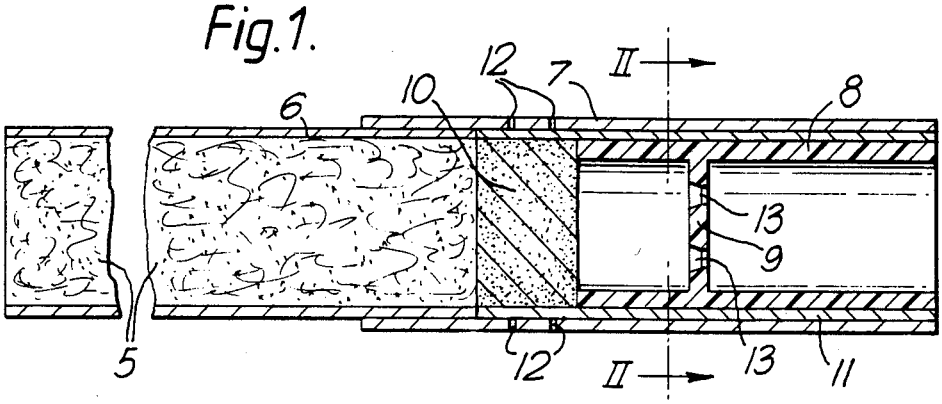
FIG. 1 is an axial section taken on the line I—I in FIG. 2.
Figure 2:
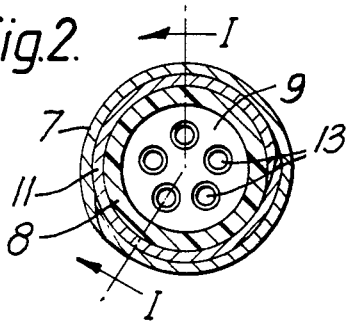
FIG. 2 is a section taken on the line II—II in FIG. 1.
Figure 3:
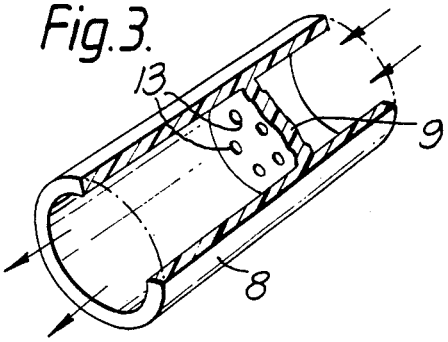
FIG. 3 is a broken perspective view of the tubular core and cross wall; and, FIG. 4 is a side view, partially cut away in axial section, of the tubular core and cross wall.

The cigarette comprises a conventional tobacco rod consisting of a filler 5 wrapped in a cigarette paper 6. The buccal end of the tobacco rod abuts the upstream end of the buccal end device and is united to it by a surrounding conventional tipping wrapper 7.

The buccal end device comprises a moulded plastics tubular core 8, which has a length of 15 mm and which is provided one third of the way along its length with an integral transverse cross wall 9. The cross wall 9 is closer to the upstream end of the tubular core which, at its upstream end, abuts a cylindrical plug 10 of conventional acetate filter material, the plug being 5 mm in axial length. The core 8 and plug 10 are united by a surrounding porous paper inner wrapper 11. The tipping wrapper 7 is provided, in alignment with the plug 10, with two rings of perforations 12.

Figure 4:
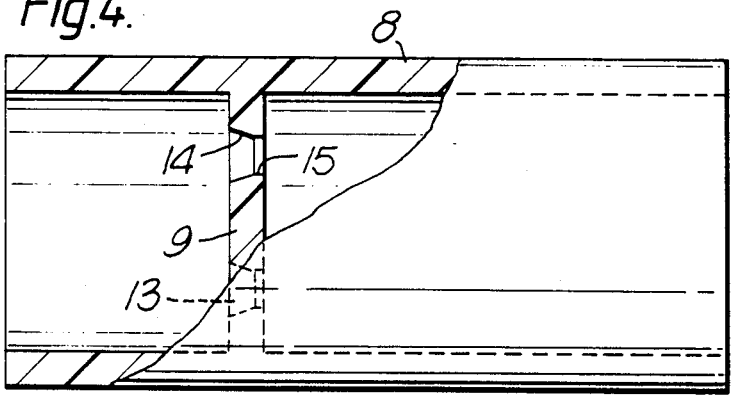

The cross wall 9 is provided with a ring of five orifices 13, the size of which is exaggerated in the drawings for simplicity of explanation as to their shape. As shown, particularly, in FIG. 4, each orifice 13 consists of a frustoconical portion 14 leading from its entrance into a cylindrical portion 15 which extends to the orifice exit. In a typical example, the cross wall 9 is 0.4 mm thick, each orifice 13 is of circular cross section, and cylindrical portion 15 of each orifice has a diameter of 0.48 mm and an axial length of 0.1 mm, and the bevelled portion 15 has an included conical angle of between 40° and 80°, preferably 60°.

The wider end of each orifice faces in the upstream direction. When there are five orifices 13, and the aggregate cross sectional area of the constricted exits of each orifice is 0.90 sq.mm, the pressure drop is found to be 36 mm of water, compared to 42 mm of water when the holes are inverted so that their narrower ends face in the upstream direction. Similarly, when the number of holes is changed to 4 with an aggregate cross sectional area of 0.72 sq.mm, the pressure drop is found to be 51 mm of water as compared to 67 mm of water when the direction of the holes is inverted.

In practice the smoker draws on the downstream end of the cigarette and causes ventilating air to enter the plug 10 through the perforations 12 and porous inner wrapper 11, to mingle with the smoke from the tobacco rod. The mixture passes through the void in the core 8 upstream of the cross wall 9, and through the orifices 13. The mixture leaves the orifices as turbulent jets which dissipate into eddies while passing through the longer void in the core 8 downstream of the cross wall 9, before passing into the smoker's mouth through the open end of the core. The invention is believed to produce remarkable reductions in carbon monoxide yields and particularly in the ratio of carbon monoxide to water and nicotine free particulate matter, as indicated in the accompanying table which shows a comparison of a conventional ventilated cigarette having an acetate filter with a cigarette which is similar except for the substitution of the new end device for the acetate filter.

| Type of Cigarette | Cigarette Pressure Drop ($mm/H_2O$) | Cigarette Ventilation % | Yield Particulate matter (water and nicotine free) | CO Yield (mg/cig) | CO: PM Ratio |
|---|---|---|---|---|---|
| Conventional Ventilated Cigarette | 100 | 35 | 9.5 | 10.6 | 1.1 |
| Cigarette with New End Device | 67 | 63 | 9.6 | 4.8 | 0.5 |

Furthermore, a panel of smokers comparing these two cigarettes has concluded that the cigarette with the new end device is easier to draw and produces more smoke taste.

We claim:

1. A device for the buccal end of a smoking rod having associated therewith ventilating means for introducing ventilating air, said device comprising a tubular core having upstream and downstream ends and adapted, in use, to be connected at said upstream end thereof to a buccal end of a smoking rod, whereby smoke from said smoking rod and ventilating air are drawn through said core by the smoker; said core being provided, partway along the interior thereof, with a transverse cross wall having a plurality of constricting orifices formed therethrough, the widths of said orifices being sufficiently small as to provide a desired high pressure drop in said end device, the number of said orifices being such as to provide the desired aggregate flow through said end device, each of said orifices having an entrance nearer to said upstream end of said core and an exit nearer to said downstream end of said core; wherein the width of each of said orifices at said entrance differs from the width at said exit; the minimum width of each of said orifices is greater than the axial length of said orifices; and a clear void exists at least 1 mm in the direction from said entrance of each of said orifices toward said upstream end of said core and from said exit of each of said orifices towards said downstream end of said core.

2. A device according to claim 1, wherein said width of each of said orifices at said entrance thereof is greater than said width at said exit thereof.

3. A device according to claim 1, wherein said clear void exists at least 5 mm from said entrance and exit of each of said orifices in said upstream and downstream directions.

4. A device according to claim 1, wherein said exit of each of said orifices is unobstructed from said atmosphere through said downstream end of said core and a clear void of at least 8 mm exists between said exit of each of said orifices and said downstream end of said core.

5. A device according to claim 1, wherein one of said entrance and exit of each of said orifices is provided by a bevelled portion, and said bevelled portion leads into a substantially cylindrical portion extending to the other of said entrance and exit.

6. A device according to claim 5, wherein the width of said cylindrical portion is greater than the axial length thereof by a factor of at least two.

7. A device according to claim 5 wherein said entrance of said orifices is provided with a bevelled portion and said bevelled portion leads to a substantially cylindrical portion extending to said exit of each of said orifices.

8. A device according to claim 1, wherein said aggregate of the cross sectional areas of the most constricted portions of all of said orifices is between 0.5 and 1.1 sq.mm.

9. A device according to claim 1, wherein said tubular core and cross wall are integrally moulded from a plastics material.

10. A device according to claim 9, wherein said plug wrapper is air permeable at least where it surrounds said plug of filter material.

11. A device according to claim 1, wherein a plug of filter material is positioned adjacent to said upstream end of said tubular core and is united with said core by a surrounding plug wrapper.

12. A smoking rod comprising a device according to claim 1, connected to the buccal end of a smoking rod by an air permeable tipping wrapper to allow ventilating air into said core through said upstream end thereof.

* * * * *